US006503091B2

(12) United States Patent
Hart et al.

(10) Patent No.: US 6,503,091 B2
(45) Date of Patent: Jan. 7, 2003

(54) HIGH SPEED BUS CONTACT SYSTEM

(75) Inventors: Frank P. Hart, Beaverton; Raviprakash Nagaraj, Hillsboro, both of OR (US); Leonard O. Turner, Vancouver, WA (US); Arthur L. Spurrell, Tualatin, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/969,457

(22) Filed: Oct. 2, 2001

(65) Prior Publication Data

US 2002/0016099 A1 Feb. 7, 2002

Related U.S. Application Data

(63) Continuation of application No. 09/061,807, filed on Apr. 16, 1998, now Pat. No. 6,322,370.

(51) Int. Cl.[7] ..... H01R 13/648

(52) U.S. Cl. ..... 439/108; 439/68

(58) Field of Search ..... 439/108, 609–610, 439/101, 325, 326, 327, 59, 629, 630, 636, 637, 62, 631, 632, 633, 634, 635, 947, 60, 260

(56) References Cited

U.S. PATENT DOCUMENTS

| | | | | |
|---|---|---|---|---|
| 4,932,884 A | | 6/1990 | Eveland | |
| 5,053,730 A | | 10/1991 | Kameya | |
| 5,478,260 A | | 12/1995 | Kaufman et al. | |
| 5,522,737 A | | 6/1996 | Brunker et al. | |
| 5,634,819 A | * | 6/1997 | Pan et al. | 439/637 |
| 5,842,885 A | | 12/1998 | Takamoto et al. | |
| 5,863,213 A | | 1/1999 | Enomoto et al. | |
| 5,882,223 A | | 3/1999 | Igarashi | |
| 5,890,917 A | * | 4/1999 | Ishida et al. | 439/101 |
| 5,908,333 A | | 6/1999 | Perino et al. | |
| 5,959,848 A | | 9/1999 | Groves et al. | |

* cited by examiner

*Primary Examiner*—P. Austin Bradley
*Assistant Examiner*—Ross Gushi
(74) *Attorney, Agent, or Firm*—Blakely, Sokoloff, Taylor & Zafman LLP

(57) ABSTRACT

The present invention is a memory bus connector for accommodating a memory module that is parallel to a motherboard. The memory bus connector of the present invention has a plurality of individual contacts that act as data signal contacts and/or ground members that connect to the lower portion the parallel memory module. The memory bus connector of the present invention also has a sheet grounding member that connects to the upper portion of the memory module.

15 Claims, 6 Drawing Sheets

HIGH SPEED BUS CONTACT SYSTEM

CROSS REFERENCE TO RELATED APPLICATION

The present patent application is a continuation of U.S. patent application Ser. No. 09/061,807 as filed on Apr. 16, 1998 now U.S. Pat. No. 6,322,370.

BACKGROUND OF THE INVENTION

1. Field of the Invention

This invention relates to the field of electrical interconnection devices, and more specifically to the field of bus connectors for portable computers.

2. Background Information

As technology grows the demand for faster more compact computers has increased. In order to reduce the size of computers and make them more portable, semiconductor devices have become and continue to become much smaller. Additionally, the layout of the semiconductor devices within a computer have become more dense. Smaller devices and more dense layouts have lead to more delicate devices and expensive repair costs.

Memory modules, for example, have become much smaller and as such the memory bus connectors within the computer itself have become smaller and more delicate. However, as technology advances computer users want to be able to easily upgrade the memory modules in their existing computer systems. Thus, it is important in the design of memory modules and memory bus connectors that they are able to withstand some abuse by the computer user when upgrading the memory modules while still maintaining the smaller and more dense layouts.

In portable computers, the space limitations have also made it important to design memory modules and memory bus connectors in a manner that would hold the memory module in a plane parallel to the motherboard rather than perpendicular to it. As illustrated in FIG. 1, memory bus connector 120 holds the memory module 100 in a horizontal fashion such that the memory module 100 is parallel to motherboard 130. The parallel memory module 100 allows the portable computer to be manufactured in thinner and smaller cases improving the portability of the computer.

Vertical memory boards which are used in desktop computers take up much more room and would require more space than is available in a portable computer such as a laptop computer. As illustrated in FIG. 2, memory bus connector 220 holds memory module 200 in a vertical fashion such that the memory module 200 is perpendicular to motherboard 230. A vertical memory module 200 would increase the thickness and overall size of the portable computer making the portable computer too big and bulky.

With parallel memory modules, however, come additional concerns. For example, a Small Outline Dual In Line Memory Module (SO-DIMM) contains about 144 individual contacts. Thus, the memory bus connector that connects the SO-DIMM to the motherboard has a corresponding number of contacts (or leads). As illustrated in FIG. 3, a prior art memory bus connector 120, which would hold the memory module 100 parallel to the motherboard, contains top leads 141 and bottom leads 142 which interconnect to the memory module 100. In the case of the SO-DIMM, memory bus connector 120 would have seventy-two (72) individual top leads 141 and seventy-two (72) individual bottom leads 142, as illustrated in FIG. 4. FIG. 5 illustrates an enlargement of a portion of the memory bus connector 120 illustrated in FIG. 4.

The individual top leads 141 and individual bottom leads 142 may be any combination of data signal contacts and ground members depending upon the contact layout of the particular memory module being used. Thus, there could be data signal contacts in both the top and bottom leads and there could also be ground members in both the top and bottom leads. Because the memory module 100 is parallel to the motherboard (i.e. horizontal), the top and bottom leads 141 & 142 are different lengths. The top leads 141 must be longer and bend up and over in order to connect the upper portion of the memory module to the motherboard and the bottom leads 142 are shorter since they connect the lower portion of the memory module to the motherboard.

One problem with this prior art design is that because the top leads 141 are longer, they necessarily have higher inductances. These higher inductances are not an issue for memory buses at present speeds (typically 66–100 MHz), but will become impediments to proper operation of future memory buses, where speeds of 400 MHz to 1 GHz are anticipated.

Another problem with the prior art design for the memory bus connector, illustrated in FIG. 4, is that there are no means for providing controlled characteristic impedances to the signal contacts. The ability to control characteristic impedances is common in other high-speed interconnection schemes, for example, backplanes. In a direct Rambus DRAM memory module it is desirable to have the ability to control the characteristic impedance to approximately 28 ohms.

In the vertical memory module 200 (illustrated in FIG. 2) the connecting leads in the memory bus connector 220 are all the same length and are very short (simply the distance from the motherboard to the connection on the memory module). The leads for the vertical memory module do not have to reach up and around the vertical memory module as they do in the horizontal (or parallel) memory module. Thus the vertical memory module and memory bus connector used in desktop computers do not have a significant problem with inductance.

What is needed is a memory bus connector that solves the problem of inductance that is prevalent in the parallel memory module design of portable computers. Additionally, what is needed is a memory bus connector that solves the problem of characteristic impedance that is also prevalent in the parallel memory module design of portable computers.

SUMMARY OF THE INVENTION

The present invention is a memory bus connector. The memory bus connector of the present invention has a plurality of individual contacts and a sheet grounding member.

Additional features and benefits of the present invention will become apparent from the detailed description, figures, and claims set forth below.

BRIEF DESCRIPTION OF THE DRAWINGS

The present invention is illustrated by way of example and not limitation in the accompanying figures in which.

DETAILED DESCRIPTION

A High Speed Bus Connector Contact System is disclosed. In the following description, numerous specific details are set forth such as specific materials, layouts, dimensions, etc. in order to provide a thorough understanding of the present invention. It will be obvious, however, to one skilled in the art that these specific details need not be employed to practice the present invention. In other instances, well known materials or methods have not been described in detail in order to avoid unnecessarily obscuring the present invention.

The present invention is a high speed bus connector system that establishes a parallel contact between the memory module and a motherboard for use in computers where space is limited, for example, portable computers or laptops. Although, the following description describes the present invention with regard to its use for a derivative of the JEDEC standard Small Outline Dual In Line Memory Module (SO-DIMM) suitable for Rambus memory devices, it will be obvious to one with ordinary skill in the art that the concepts of the present invention may be useful in other parallel mounted connectors that have similar problems and/or needs.

Figure 1:
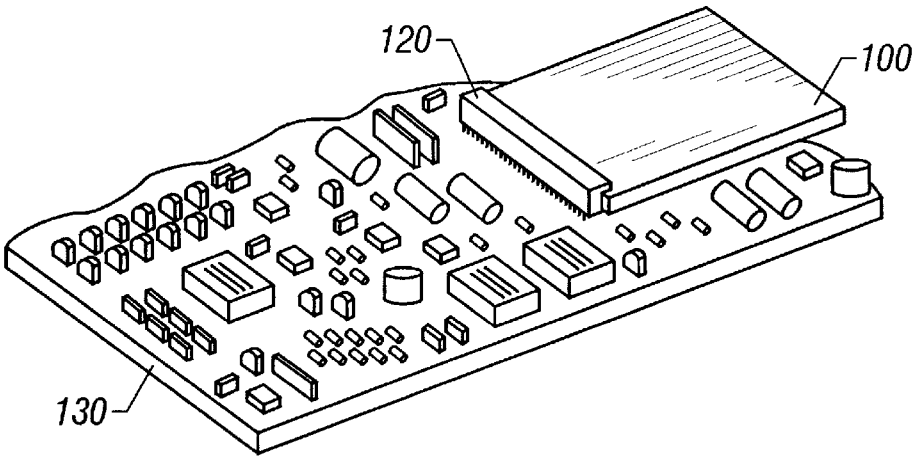
FIG. 1 (Prior Art)
FIG. 1 illustrates a parallel memory module and a motherboard.
Figure 2:
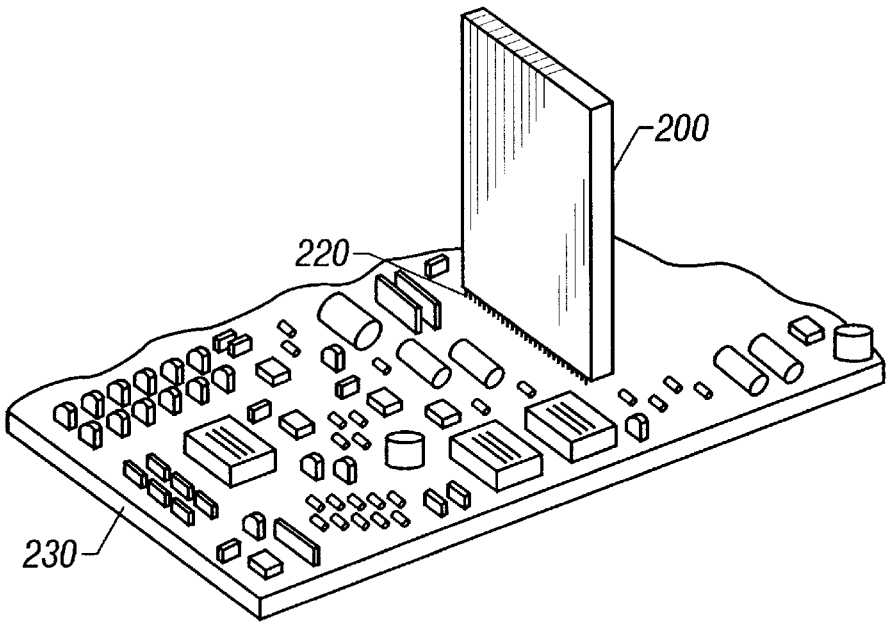
FIG. 2 (Prior Art)
FIG. 2 illustrates a vertical memory module and a motherboard.
Figure 3:
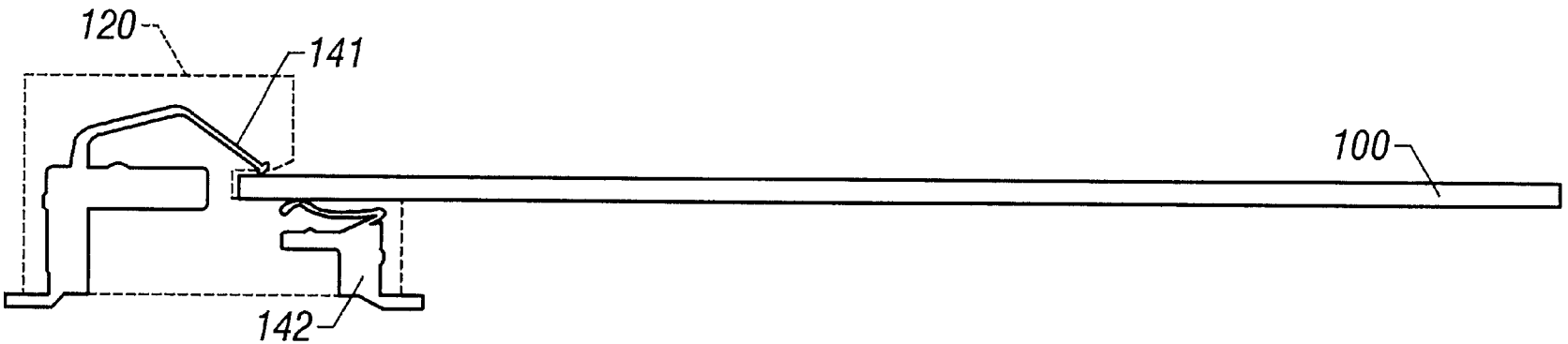
FIG. 3 (Prior Art)
FIG. 3 illustrates a prior art memory bus connector for holding a memory module parallel to a motherboard.
Figure 4:
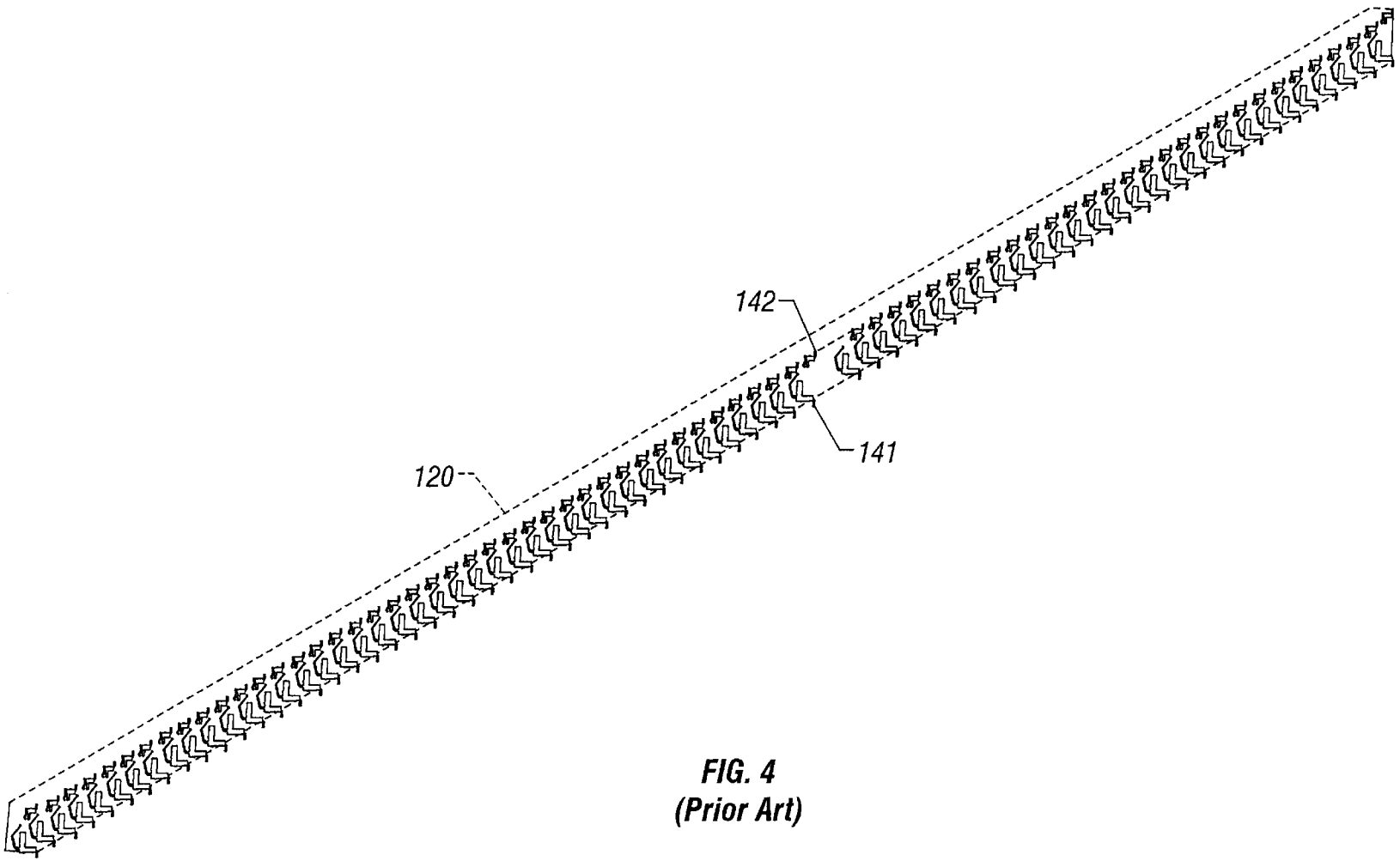
FIG. 4 (Prior Art)
FIG. 4 illustrates the prior art memory bus connector of FIG. 3.
Figure 5:
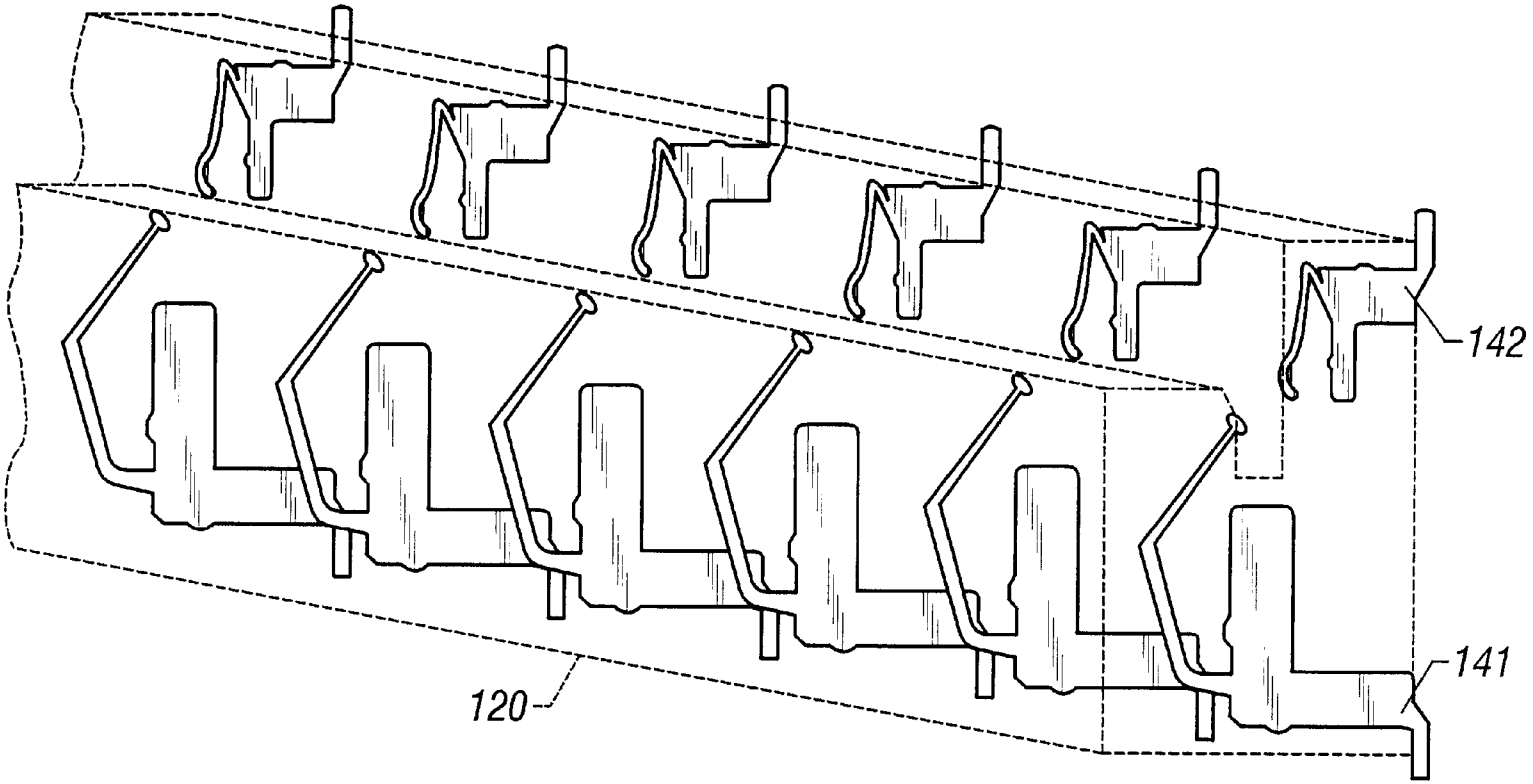
FIG. 5 (Prior Art)
FIG. 5 illustrates an enlargement of a portion of the prior art memory bus connector of FIG. 4.
Figure 6:
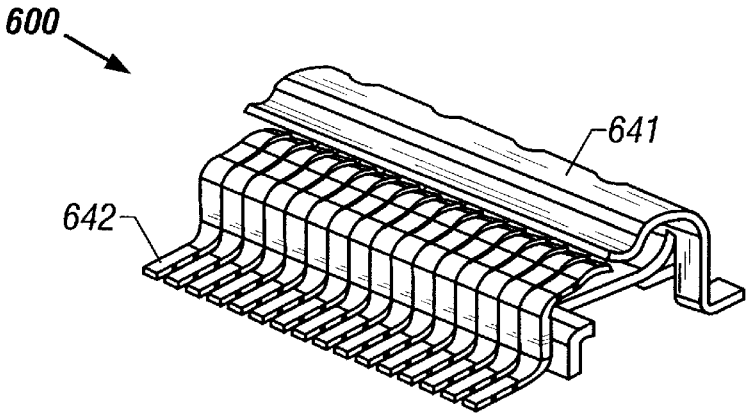
FIG. 6 illustrates an overhead view of a high speed memory bus connector according to one embodiment of the present invention.

The high speed memory bus connector (memory bus connector) of the present invention, as illustrated in FIG. 6, has individual contacts 642 on the lower portion of the memory bus connector 600 and a sheet ground member 641 on the upper portion of the memory bus connector 600. Although only 16 individual contacts 642 are illustrated in FIG. 6, it should be noted and it will be obvious to one with ordinary skill in the art that there may be any number of individual contacts 642 and that the number of individual contacts will be whatever is required to implement a given high-speed bus.

Figure 7:
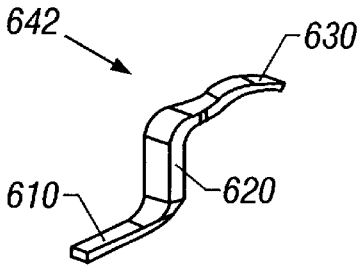
FIG. 7 illustrates one embodiment of an individual contact used in the lower portion of the memory bus connector illustrated in FIG. 6.

FIG. 7 illustrates an individual contact 642 used in the lower portion of memory bus connector 600 to connect to the bottom of a memory module. The individual contact 642 is a piece of metal bent to form a solder foot 610 that connects the individual contact 642 to a motherboard. The body 620 of the individual contact pin is usually wider than the solder foot and is used to aid in the control of the characteristic impedance as will be discussed in further detail below. Individual contact 642 also has a connecting portion 630 which is bent and/or shaped to form a contact that will directly connect to the lower surface of the memory module. The individual contacts 642 may be data signal contacts, power supply contacts, ground members, or a combination thereof depending upon the configuration of the particular memory module being used. In one embodiment of the present invention individual contacts 642 are used for signals in order to reduce the inductance of the connector since the individual contacts 642 have a shorter signal path.

Figure 8:
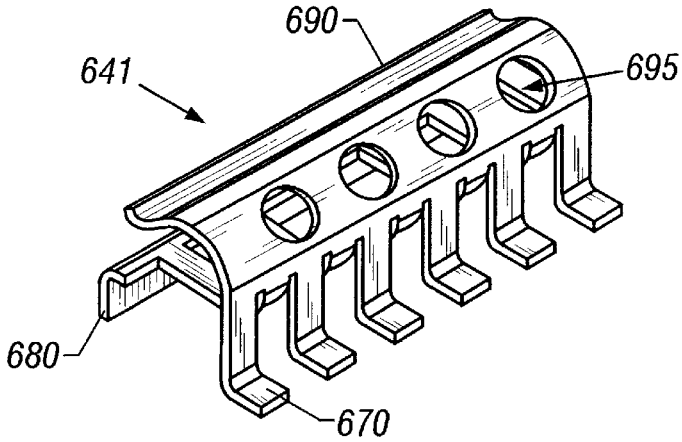
FIG. 8 illustrates one embodiment of a sheet grounding member used in the upper portion of the memory bus connector illustrated in FIG. 6.

FIG. 8 illustrates an embodiment of a sheet grounding member 641 used to connect the memory bus connector to the upper surface of a memory module. By using a sheet grounding member 641 the present invention solves the inductance problem exhibited in the prior art memory bus connector that had individual contacts to the upper surface of the memory module. In the prior art the individual upper contacts 141 of the memory bus connector 120 exhibited a high inductance problem due to their length. However, by paralleling the individual contacts together into a sheet contact, the present invention reduces the inductance to an acceptable level even though the sheet contact is still relatively long. Because the contacts would be paralleled together into a sheet, the resulting sheet contact would not likely serve well as a data signal contact for the memory module, however it would serve well as a universal power or ground member for the memory module and the corresponding individual contacts 642 on the lower portion of the memory bus connector 600. In addition, the sheet contact would provide a means of controlling the impedance of signal contacts.

Figure 9:
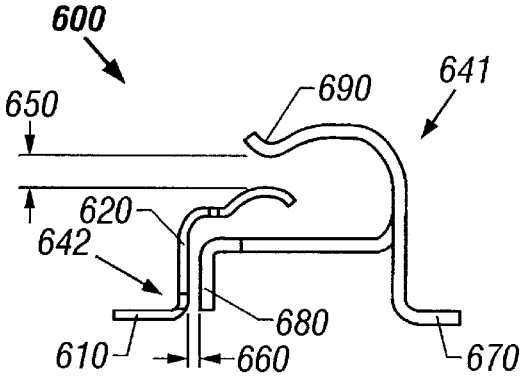
FIG. 9 illustrates a side view of a high speed memory bus connector according to one embodiment of the present invention.

In one embodiment of the present invention the sheet grounding member is made from a solid sheet of metal, as is illustrated in FIG. 8. The solid sheet is bent in certain areas to form an upper connection portion 690 for coupling to the upper surface of the memory module. The metal sheet is also cut (or notched) and bent to create solder feet 670 for connecting the sheet grounding member 641 to a motherboard. The sheet grounding member may also be cut and bent to create a reference ground plane 680 that extends outwardly from the sheet grounding member 641 to come into close proximity with the individual contacts 642 on the lower portion of the memory bus connector 600, as is illustrated in FIG. 9.

The embodiment of the sheet grounding member 641 illustrated in FIG. 8, also illustrates knit-paths 695 which are holes in the sheet grounding member that enable the molding of a connector body around the grounding member. For example, the prior art memory bus connector was molded in a connector body made of plastic which held the individual contacts in place. Thus, a similar connector body could be used to hold the sheet grounding member 641 and the individual contacts 642 in the formation illustrated in FIG. 9. The knit-paths 695 are optional and are merely illustrated as an example of how a connector body may be molded around sheet grounding member 641. It will be obvious to one with ordinary skill in the art that other means for connecting the grounding member 641 to a connector body may be used.

Figure 10:
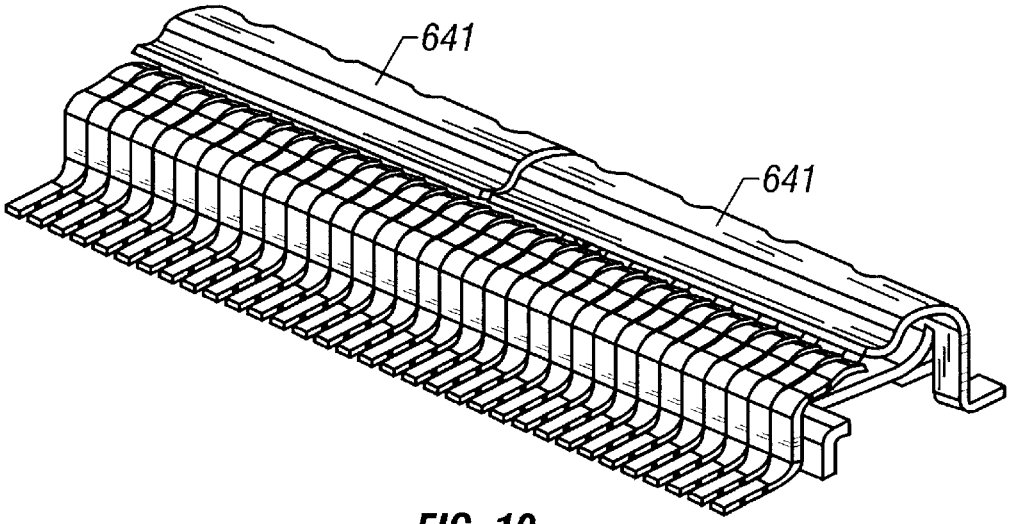
FIG. 10 illustrates an overhead view of a high speed memory bus connector according to another embodiment of the present invention.

It should be noted that although the sheet ground member 641 is illustrated in FIGS. 6–9 as being a single solid piece it may be advantageous and is within the scope of the present invention to make the upper portion of the memory bus connector out of two or more electrically distinct sheet ground members 641 as is illustrated in FIG. 10. It should be noted that the number of electrically distinct sheet grounding members 641 used will depend upon the particular specifications required by the manufacturer and the inductance levels tolerable by the corresponding memory module. It should also be noted that it may be advantageous and is within the scope of the present invention to make the sheet grounding member from several different pieces of metal and attaching them together rather than cutting and bending a solid sheet of metal. For example the reference ground plane 680 could be a separate piece of metal that is later soldered onto the frame of the sheet grounding member 641.

Reference ground plane 680 is optional in the design of the present invention, however, it enables the manufacturer to "control" the characteristic impedance of the memory bus connector 600 to their desired specifications. By placing the reference ground plane 680 in close proximity with the individual contacts 642 (in particular the individual contacts that are data signal contacts) allows the characteristic impedance to be controlled.

As illustrated in FIG. 9, the value of the characteristic impedance can be raised or lowered by changing the impedance gap spacing 660 (i.e. increasing or decreasing the gap) between the reference ground plane 680 and the individual contact 642. The characteristic impedance may also be changed by placing a dielectric material (not shown) in the impedance gap spacing 660 between the reference ground plane 680 and the individual contact 642. The characteristic impedance will be inversely proportional to the square root of the dielectric constant of the material used. As an example, air has a dielectric constant of 1, bakelite has dielectric constant of 4.74, and silica ($SiO_2$) has a dielectric constant of 3.8. Thus, if the impedance gap spacing 660 between the individual contact 642 and reference ground plane 680 is filled with silica, for example, then the characteristic impedance of the signal contacts would be reduced by approximately 50% from a gap spacing containing only air. Additionally, the characteristic impedance may be affected by the size of the body 620 of the individual contact 642. In other words the thickness and/or width of the individual contact may be varied in order to increase or decrease the characteristic impedance.

FIG. 9 illustrates the relative positions of the individual contacts 642 to the sheet grounding member 641 of the memory bus connector of one embodiment of the present invention. The individual contact 642 and the sheet grounding member 641 are positioned such that two gaps are created between them. One gap is the memory module gap 650. The memory module gap 650 is where the memory module plugs into the memory bus connector 600. The upper surface of the memory module couples with the sheet grounding member 641 at the upper connection point 690. The lower surface of the memory module couples with the individual contact 642 at connecting point 630.

The second gap, which is optional depending upon if the memory bus connector includes the optional reference ground plane 680, is the impedance gap spacing 660. Impedance gap spacing 660 is the gap between the reference ground plane 680 and the body 620 of the individual contact 642. As stated above with regard to the discussion of the "tuning" of the characteristic impedance the impedance gap spacing 660 may be increased, decreased, or filled with a dielectric material in order to control the characteristic impedance of the memory bus connector 600.

Figure 11:
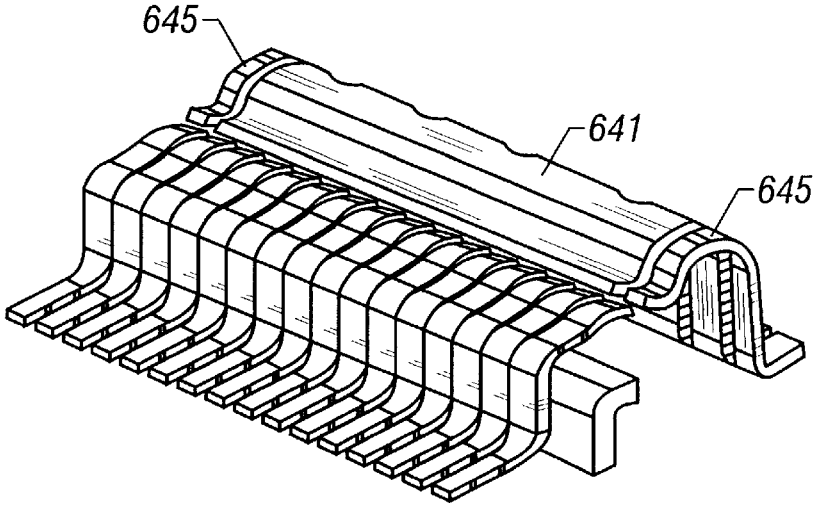
FIG. 11 illustrates an overhead view of a high speed memory bus connector according to yet another embodiment of the present invention.

Yet another embodiment of the present invention is illustrated in FIG. 11. The memory bus connector system of FIG. 11 illustrates sheet grounding member 641 having much smaller electrically isolated contact members 645. Electrically isolated contact members (contact members) 645 may be power connections or data signal connections. Although, FIG. 11 illustrates contact members 645 as being located on both sides of sheet grounding member 641 it should be noted that contact members 645 may be a single electrically isolated member on only one side, there could be several contact members 645 on a side, etc. Also, in the embodiment where there is more than one sheet grounding member 641, contact members 645 may be located between the sheet grounding members 641. The individual contacts 642 located opposite the contact members 645 may be data signal contacts, power connections, or ground members where the characteristic impedance would not be a concern.

Thus, a high speed memory bus contact system has been described. Although specific embodiments, including specific equipment, layouts, and materials have been described, various modifications to the disclosed embodiments will be apparent to one of ordinary skill in the art upon reading this disclosure. Therefore, it is to be understood that such embodiments are merely illustrative of and not restrictive on the broad invention and that this invention is not limited to the specific embodiments shown and described.

What is claimed is:

1. A bus connector comprising:

a lower portion to contact a lower surface of a memory module, said lower portion including a plurality of individual contacts, wherein each of said plurality of individual contacts is selected from a group consisting of: a signal contact, a power supply contact, and a ground member; and an upper portion to contact an upper surface of said memory module, said upper portion including a sheet grounding member, at least one contact member, and a reference ground plane extending from said sheet grounding member towards said plurality of individual contacts, wherein said at least one contact member is electrically isolated from said sheet grounding member and is selected from a group consisting of: a signal contact and a power supply contact.

2. The bus connector of claim 1, wherein said sheet grounding member serves as a ground reference for each of said plurality of individual contacts.

3. The bus connector of claim 1, wherein each of said plurality of individual contacts has a controlled width to control an impedance between said plurality of individual contacts and said sheet grounding member.

4. The bus connector of claim 1, further comprising:

a first gap between said plurality of individual contacts and said sheet grounding member to accommodate said memory module; and a second gap between said plurality of individual contacts and said sheet grounding member.

5. The bus connector of claim 4, wherein said second gap between said plurality of individual contacts and said sheet grounding member is sized to control an impedance between said plurality of individual contacts and said sheet grounding member.

6. The bus connector of claim 4, wherein said second gap between said plurality of individual contacts and said sheet grounding member is filled with a dielectric material selected from a group consisting of: air, bakelite, and silica.

7. A motherboard comprising:

a bus; and a bus connector, said bus connector including:

a lower portion to contact a lower surface of a memory module, said lower portion including a plurality of individual contacts, wherein each of said plurality of individual contacts is selected from a group consisting of: a signal contact, a power supply contact, and a ground member; and an upper portion to contact an upper surface of said memory module, said upper portion including a sheet grounding member, at least one contact member, and a reference ground plane extending from said sheet grounding member towards said plurality of individual contacts, wherein said at least one contact member is electrically isolated from said sheet grounding member and is selected from a group consisting of: a signal contact and a power supply contact.

8. The mother board of claim 7, wherein said sheet grounding member serves as a ground reference for each of said plurality of individual contacts.

9. The motherboard of claim 7, wherein each of said plurality of individual contacts has a controlled width to control an impedance between said plurality of individual contacts and said sheet grounding member.

10. The motherboard of claim 7, said bus connector further including:

a first gap between said plurality of individual contacts and said sheet grounding member to accommodate said memory module; and a second gap between said plurality of individual contacts and said sheet grounding member.

11. The motherboard of claim 10, wherein said first gap between said plurality of individual contacts and said sheet grounding member to accommodate said memory module comprises a first gap to accommodate a memory module in a plane parallel to said motherboard.

12. The motherboard of claim 10, wherein said second gap between said plurality of individual contacts and said sheet grounding member is sized to control an impedance between said plurality of individual contacts and said sheet grounding member.

13. The motherboard of claim 10, wherein said second gap between said plurality of individual contacts and said sheet grounding member is filled with a dielectric material selected from a group consisting of: air, bakelite, and silica.

14. A bus connector comprising:

a lower portion to contact a lower surface of a memory module, said lower portion including a plurality of individual contacts wherein each of said plurality of individual contacts is selected from a group consisting of a signal contact, a power supply contact, and a ground member;

an upper portion to contact an upper surface of said memory module, said upper portion including a sheet grounding member, at least one contact member, and a reference ground plane extending from said sheet grounding member towards said plurality of individual contacts, wherein said at least one contact member is electrically isolated from said sheet grounding member and is selected from a group consisting of: a signal contact and a power supply contact;

a first gap between said plurality of individual contacts and said sheet grounding member to accommodate said memory module; and a second gap between said plurality of individual contacts and said reference ground plane.

15. A motherboard comprising:

a bus; and a bus connector, said bus connector including:

a lower portion to contact a lower surface of a memory module, said lower portion including a plurality of individual contacts wherein each of said plurality of individual contacts is selected from a group consisting of: a signal contact, a power supply contact, and a ground member;

an upper portion to contact an upper surface of said memory module, said upper portion including a sheet grounding member, at least one contact member, and a reference ground plane extending from said sheet. grounding member towards said plurality of individual contacts, wherein said at least one contact member is electrically isolated from said sheet grounding member and is selected from a group consisting of: a signal contact and a power supply contact, a first gap between said plurality of individual contacts and said sheet grounding member to accommodate said memory module; and a second gap between said plurality of individual contacts and. said reference ground plane.

* * * * *